US006167923B1

(12) United States Patent
Hartsell, Jr.

(10) Patent No.: US 6,167,923 B1
(45) Date of Patent: Jan. 2, 2001

(54) VAPOR RECOVERY DIAGNOSTICS

(75) Inventor: Hal C. Hartsell, Jr., Kernersville, NC (US)

(73) Assignee: Marconi Commerce Systems Inc., Greensboro, NC (US)

( * ) Notice: Under 35 U.S.C. 154(b), the term of this patent shall be extended for 0 days.

(21) Appl. No.: 09/387,471

(22) Filed: Sep. 1, 1999

(51) Int. Cl.[7] ..... B65B 1/04
(52) U.S. Cl. ..... 141/192; 141/59; 141/83
(58) Field of Search ..... 141/59, 83, 94, 141/192

(56) References Cited

U.S. PATENT DOCUMENTS

| | | | |
|---|---|---|---|
| 5,484,000 | 1/1996 | Hasselmann | 141/7 |
| 5,605,182 | 2/1997 | Oberrecht et al. | 141/94 |
| 5,620,031 | 4/1997 | Dalhart et al. | 141/206 |
| 5,636,667 | 6/1997 | Young et al. | 141/59 |
| 5,671,785 | 9/1997 | Andersson | 141/59 |
| 5,676,181 | 10/1997 | Healy | 141/59 |
| 5,765,603 | 6/1998 | Healy | 141/59 |
| 5,782,275 * | 7/1998 | Hartsell, Jr. et al. | 141/94 |

* cited by examiner

*Primary Examiner*—Steven O. Douglas
(74) *Attorney, Agent, or Firm*—Coats & Bennett, P.L.L.C.

(57) ABSTRACT

A method for monitoring the operation of a vacuum assist vapor recovery system used in conjunction with the fueling of ORVR and non-ORVR equipped vehicles including establishing an expected number of ORVR fueling operations for a fuel dispenser during a defined interval; counting the actual number of ORVR fueling operations during said defined interval; comparing the actual number of fueling operations to the expected number of fueling operations; and permitting fueling operations to continue if the actual number is substantially equal to the expected number.

31 Claims, 4 Drawing Sheets

VAPOR RECOVERY DIAGNOSTICS

BACKGROUND OF THE INVENTION

1. Field of the Invention

The present invention relates to the field of fuel dispenser vapor recovery, and, more particularly to the diagnostic monitoring of such systems to ensure that they are operating properly.

2. Description of the Prior Art

During a conventional or standard automobile fueling operation, incoming fuel displaces fuel vapor from the head space of the automobile fuel tank and out through the filler pipe if not contained and recovered. The air pollution resulting from this situation is undesirable and has been the subject of considerable regulatory action.

Increasingly, environmental protection regulations require that fuel dispensers used for fueling automobiles recover vapors generated during the fueling process. These regulations typically require that a high percentage, typically 95%, of the generated vapors be recovered. The systems designed to do so include the "balance" system and the more commonly used "vacuum assist" system. Each of these systems returns the recovered vapors to the underground storage tanks at the fueling location. The equipment involved in this vapor recovery process has evolved to a high state of sophistication. For example the systems disclosed in U.S. Pat. Nos. 5,040,577 to Pope; 5,156,199 to Hartsell et al.; and 5,355,915 provide for the monitoring of the volume of liquid dispensed and the correlation of that volume to an expected vapor flow volume so that these volumes may be equalized or otherwise adjusted to maximize the recovery of fueling-generated vapors.

The need to meet increasingly strict air quality standards has led to the development of automobile-based vapor management systems. In this regard, onboard, or vehicle carried, fuel vapor recovery and storage systems (commonly referred to as onboard recovery vapor recovery or ORVR) have been developed in which the head space in the vehicle fuel tank is vented through an activated charcoal-filled canister so that the vapor is adsorbed by the activated charcoal. Subsequently, the fuel vapor is withdrawn from the canister into the engine intake manifold for mixture and combustion with the normal fuel and air mixture. The fuel tank head space must be vented to enable fuel to be withdrawn from the tank during vehicle operation.

In typical ORVR systems, a canister outlet is connected to the intake manifold of the vehicle engine through a normally closed purge valve. The canister is intermittently subjected to the intake manifold vacuum with the opening and closing of the purge valve between the canister and intake manifold. A computer which monitors various vehicle operating conditions controls the opening and closing of the purge valve to assure that the fuel mixture established by the fuel injection system is not overly enriched by the addition of fuel vapor from the canister to the mixture.

Fuel dispensing systems having vacuum assisted vapor recovery capability which are unable to detect ORVR systems will continue to operate at full capacity even though there is likely no need to do so. This situation can cause the vacuum assist systems to ingest excessive air into the underground storage tank. The tanks can then experience an excessive pressure buildup due to the expanded volume of hydrocarbon saturated air. Recognizing an ORVR system and adjusting the fuel dispenser's vapor recovery system accordingly eliminates the redundancy associated with operating two vapor recovery systems for a given fueling operation. Thus, a number of systems have been devised to detect the presence of ORVR vehicles during a fueling operation and to adjust the operation of the vacuum assist systems accordingly. One such system is disclosed in U.S. Pat. No. 5,782,275, the content of which is incorporated herein by reference. This patent discloses a system using a hydrocarbon sensor to detect hydrocarbon concentrations in the vapor path in order to determine the presence of an ORVR-equipped vehicle. Other systems may monitor pressure levels in the vapor return line, receive information directly from the vehicle, or read information on the vehicle to determine whether or not the vehicle is equipped with an ORVR system. Regardless of the type of detection system used, there is a need to determine whether or not these detection systems are working properly or if any part of these detection systems have failed. This is especially true for ORVR detection systems incorporating various types of sensors or communication electronics that could fail and provide no warning to the station operator.

SUMMARY OF THE INVENTION

The present invention relates to a system and method for monitoring the operation of a vacuum assist vapor recovery system used in conjunction with the fueling of ORVR and non-ORVR equipped vehicles. In particular, the present invention compares a value dependent on the number of ORVR fueling operations at a given fueling position with a reference value to predict whether or not there is a problem in a system used to detect an ORVR equipped vehicle. There are numerous ways to monitor the number of ORVR fueling operations and compare them to a reference. For example, the performance of any given fueling position may be compared to another fueling position, such as a fueling position on the opposite side of the dispenser. Alternatively, a comparison could be made to the performance of other fueling positions throughout the fueling environment or any group of dispensers therein. Further, the reference group may or may not include the fueling position being monitored.

Various types of comparisons are possible. For example, comparisons could include simply the number of fueling operations in which an ORVR equipped vehicle was detected. This number could be a running total or a total over a specific period. The period may have just ended or be one taken as a historical record. The comparison may be made with the ratio of fueling operations where an ORVR vehicle was detected to the number of fueling operations where an ORVR vehicle was not detected. Like the above, these comparisons may be made to a historical analysis at any given fueling position, to another fueling position, or to an average of a group of fueling positions.

Accordingly, an exemplary method of carrying out the invention includes establishing an expected number of ORVR fueling operations for a fuel dispenser during a given time interval; counting the actual number of ORVR fueling operations during said given time interval; comparing the actual number of fueling operations to the expected number of fueling operations; and permitting fueling operations to continue if the actual number is substantially equal to the expected number. In a preferred embodiment an error signal is generated if the actual number of ORVR fueling operations is not substantially equal to the expected number of ORVR fueling operations. Fueling operations are stopped or an alarm or signal status is generated if the actual number of ORVR fueling operations is not substantially equal to the expected number of ORVR fueling operations.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE PREFERRED EMBODIMENT

Figure 1:
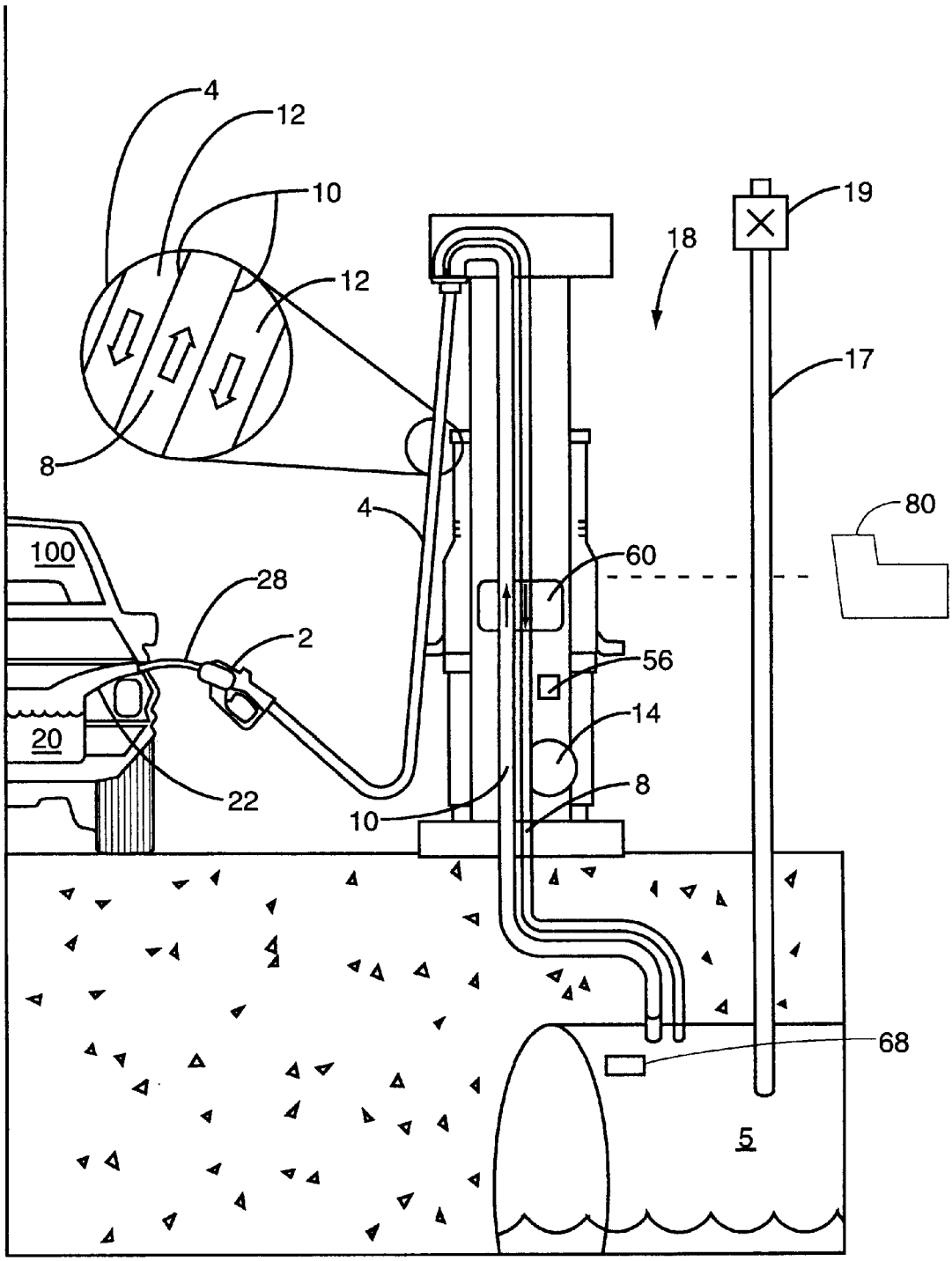
FIG. 1 is an elevational and partial sectional view of a typical gasoline dispenser installation having a vapor recovery system.

Referring now to the drawings in general and FIG. 1 in particular, it will be understood that the illustrations are for the purpose of describing a preferred embodiment of the invention and are not intended to limit the invention thereto. As best seen in FIG. 1, in a typical service station, an automobile 100 is shown being fueled from a gasoline dispenser or pump 18. A spout 28 of nozzle 2 is shown inserted into a filler pipe 22 of a fuel tank 20 during the refueling of the automobile 100.

A fuel delivery hose 4 having vapor recovery capability is connected at one end to the nozzle 2, and at its other end to the fuel dispenser 18. As shown by the cutaway view of the interior of the fuel delivery hose 4, an annular fuel delivery passage 12 is formed within the fuel delivery hose 4 for distributing liquid gasoline pumped from an underground storage tank 5 to the nozzle 2. Also within the fuel delivery hose 4 is a tubular vapor recovery passage 8 that normally transfers fuel vapors expelled from the vehicle's fuel tank 20 to the underground storage tank 5. The fuel delivery hose 4 is depicted as having an internal vapor recovery hose 10 for creating the vapor recovery passage 8. The fuel delivery passage 12 is formed between the hose 10 and hose 4. The terms vapor recovery passage and vapor return passage as used herein are defined to mean the entire flow path along which vapors recovered from a vehicle travel as they are returned to a storage point. One such storage point is an underground tank, however, other types of storage points, including intermediate vapor collection devices may also be used. Thus, any device installed in a vapor return passage may be installed at any point along the path described above.

A vapor recovery pump 14 provides a vacuum in the vapor recovery passage 8 for removing fuel vapor during a refueling operation. The vapor recovery pump 14 may be placed anywhere along the vapor recovery passage 8 between the nozzle 2 and the underground fuel storage tank. The vapor recovery system using the pump 14 may be any suitable system such as those shown in U.S. Pat. Nos. 5,040,577 to Pope, 5,195,564 to Spalding, 5,333,655 to Bergamini et al., or 3,016,928 to Brandt, the content of which is incorporated herein by reference. Various ones of these systems are now in commercial use.

As shown in FIG. 1, the underground tank 5 includes a vent 17 and a pressure-vacuum vent valve 19 for venting the underground tank 5 to atmosphere. The vent 17 and vent valve 19 allow the underground tank 5 to breathe in order to substantially equalize the ambient and tank pressures. In typical applications, maintaining tank pressure between the limits of pressure and vacuum is sufficient. Typical ranges of pressure and vacuum will range between +3 inches of water to −8 inches of water.

Figure 2:
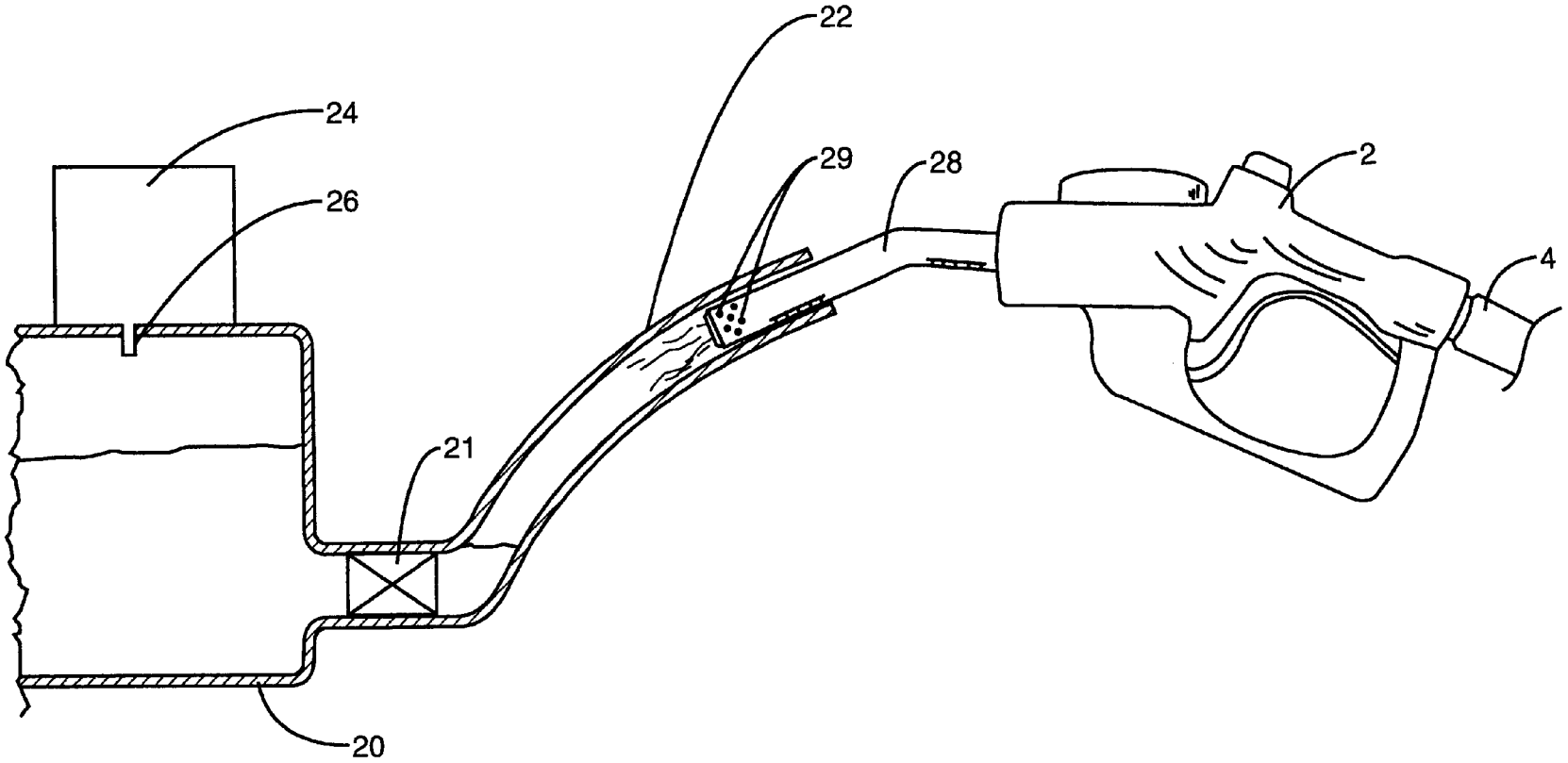
FIG. 2 depicts a typical vacuum assist vapor recovery nozzle and the cross section of a fuel tank of a vehicle equipped with onboard recovery vapor recovery.

Turning now to FIG. 2, there is illustrated a schematic representation of a vehicle fuel tank 20 of an ORVR vehicle having an associated onboard vapor recovery system 24. These onboard vapor recovery systems 24 typically have a vapor recovery inlet 26 extending into the tank 20 (as shown) or the filler pipe 22 and communicating with the vapor recovery system 24. In the ORVR system of FIG. 2, incoming fuel provides a temporary seal in fill neck 22 to prevent vapors within the tank 20 from escaping. This sealing action is often referred to as a liquid seal. As the tank fills, pressure within tank 20 increases and forces vapors into the vapor recovery system 24 through the vapor recovery inlet 26. Other ORVR systems may use a check valve 21 along the fill neck 22 to prevent further loss of vapors. The check valve 21 is normally closed and opens when a set amount of gasoline accumulates over the check valve within the fill neck 22.

The spout 28 of the nozzle 2 has numerous apertures 29. The apertures 29 provide an inlet for fuel vapors to enter the vapor recovery path 8 of fuel dispenser 18 from the vehicle's filler pipe 22. As liquid fuel rushes into the fuel tank 20 during a fueling of a vehicle not equipped with an ORVR system, fuel vapors are forced out of the fuel tank 20 through the fill pipe 22. The fuel dispenser's vapor recovery system pulls fuel vapor through the vapor recovery apertures 29, along the vapor recovery path 8 and ultimately into the underground tank 5 (as shown in FIG. 1).

In a preferred embodiment, the present invention would be incorporated into dispenser electronics illustrated schematically as 60 in FIG. 1. The diagnostics capability can be provided either in the form of additional software instructions added to existing dispenser electronics or in the form of additional integrated circuit components added to existing dispenser electronic circuitry. Dispenser electronics 60 may be in electronic communication with a central site controller 80. Thus, in another alternative embodiment, the diagnostic function of the present invention may be carried out in the site controller based on the information reported to the site controller 80 by dispenser 18. The site controller may also monitor the operation of the dispenser 18 and generate an alarm signal as discussed in more detail below.

The practice of the present invention includes monitoring the operation of the dispenser vapor recovery system as it makes a series of ORVR vehicle determinations to identify a pattern of results in those determinations indicative of a system failure. The basis for this monitoring is that in a given automobile population there are an expected number of vehicles that would be equipped with ORVR systems. Thus, during a given period of time, each dispenser should detect a substantially similar number of ORVR-equipped vehicles. By way of example, if 20% of the population of vehicles in a particular area is made up of ORVR-equipped vehicles, then it would be expected that a dispenser at a location that sees a representative population of those vehicles would detect substantially the same number or percentage of ORVR-equipped vehicles.

Figure 3:
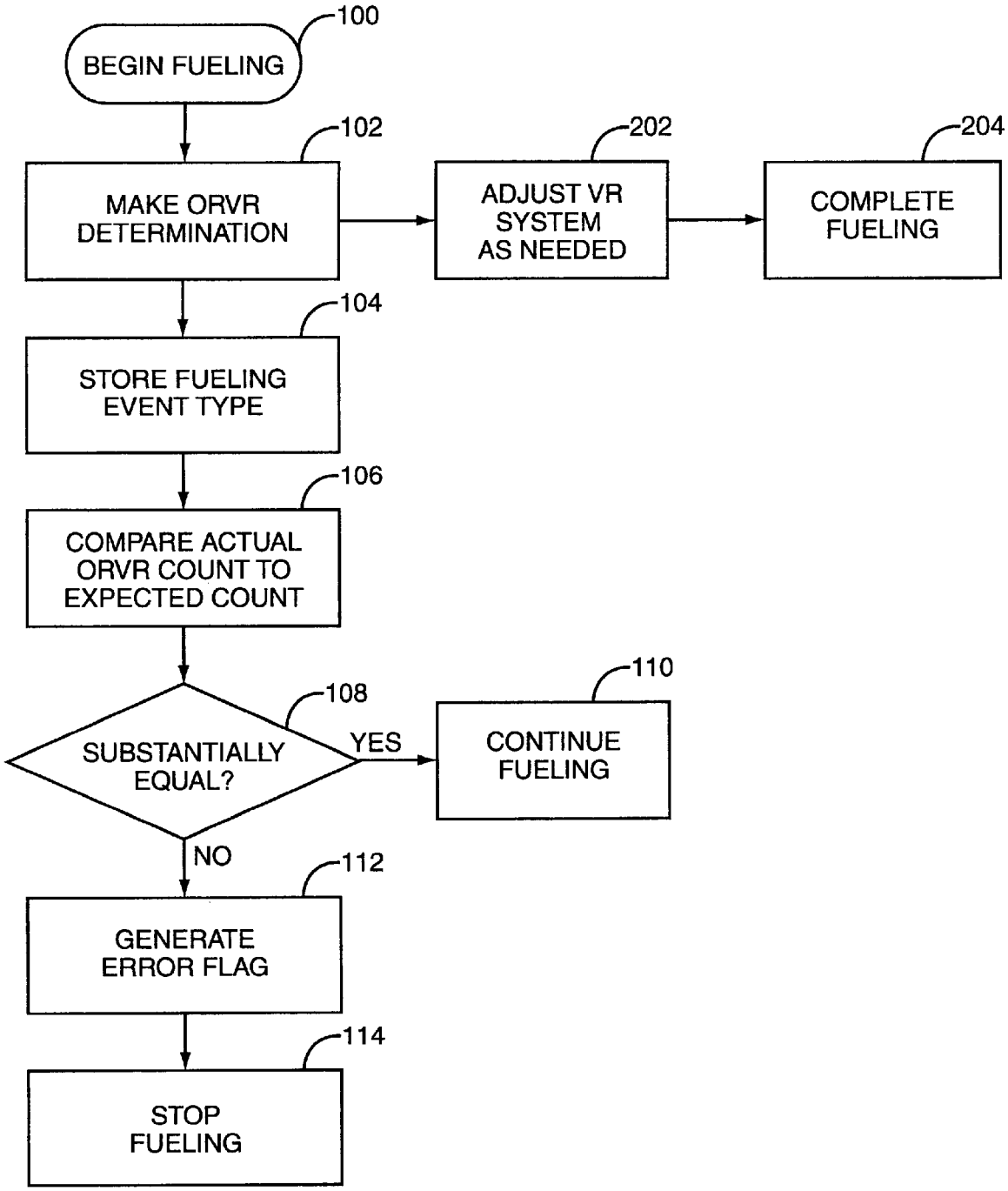
FIG. 3 is a flow chart illustrating the logic of the diagnostic system of the present invention.

Turning now to FIG. 3, there is illustrated a method for monitoring the operation of a vacuum assist vapor recovery system used in conjunction with the fueling of ORVR and non-ORVR equipped vehicles in the manner described above. The method begins with the initiation of the fueling process 100 at which time the site vapor recovery system makes a determination 102 of whether or not a vehicle is ORVR-equipped. Based on that determination the vapor recovery system adjusts its operation as needed 202 and the fueling operation is completed 204. The ORVR determination 102 and system adjustment 202 may be carried out in a dispenser sub-system capable of making an ORVR vehicle determination during a fueling operation.

At the same time that the ORVR determination is made 102, the results of that determination are stored as indicated at 104 in a memory location. The memory location maintains data on the total number of fueling operations, the number of ORVR determinations and the number of non-ORVR determinations.

Next, the actual number of ORVR determinations is compared to a stored expected count 106. Query 108 asks whether the actual count is substantially equal to the expected count. By "substantially equal" it is meant that the two counts need not be exactly the same. Rather, if the two counts are within a predetermined number or percentage of each other then they are considered "substantially equal." However, this approach may be necessary to comprehend the situation where a particular location in a geographic area may for some reason not see as many ORVR-equipped vehicles as might be expected for any one of a number of reasons. Conversely, a location may see many more ORVR-equipped vehicles that might be expected given the numbers in the general population. The difference in counts that can be tolerated to meet the "substantially equal" standard may be varied as needed depended on the operating conditions within a particular geographic area.

If query 108 answers yes, then the fueling operation is permitted to continue 110. If query 108 answers no, then an error flag is generated 112. At this point fueling could be permitted to continue while operating personnel are alerted to take steps to determine whether the dispenser vapor recovery system is operating properly. Alternatively, fueling operations could be halted when this condition is detected 114.

In an alternative embodiment of the present invention the hydrocarbon sensor diagnostics could further include a comparison of the operations of one side of a dispenser to that of the other side of the dispenser. It is expected that the comparison proceeding just described would provide a higher confidence estimate of an intermittent operating problem.

Figure 4:
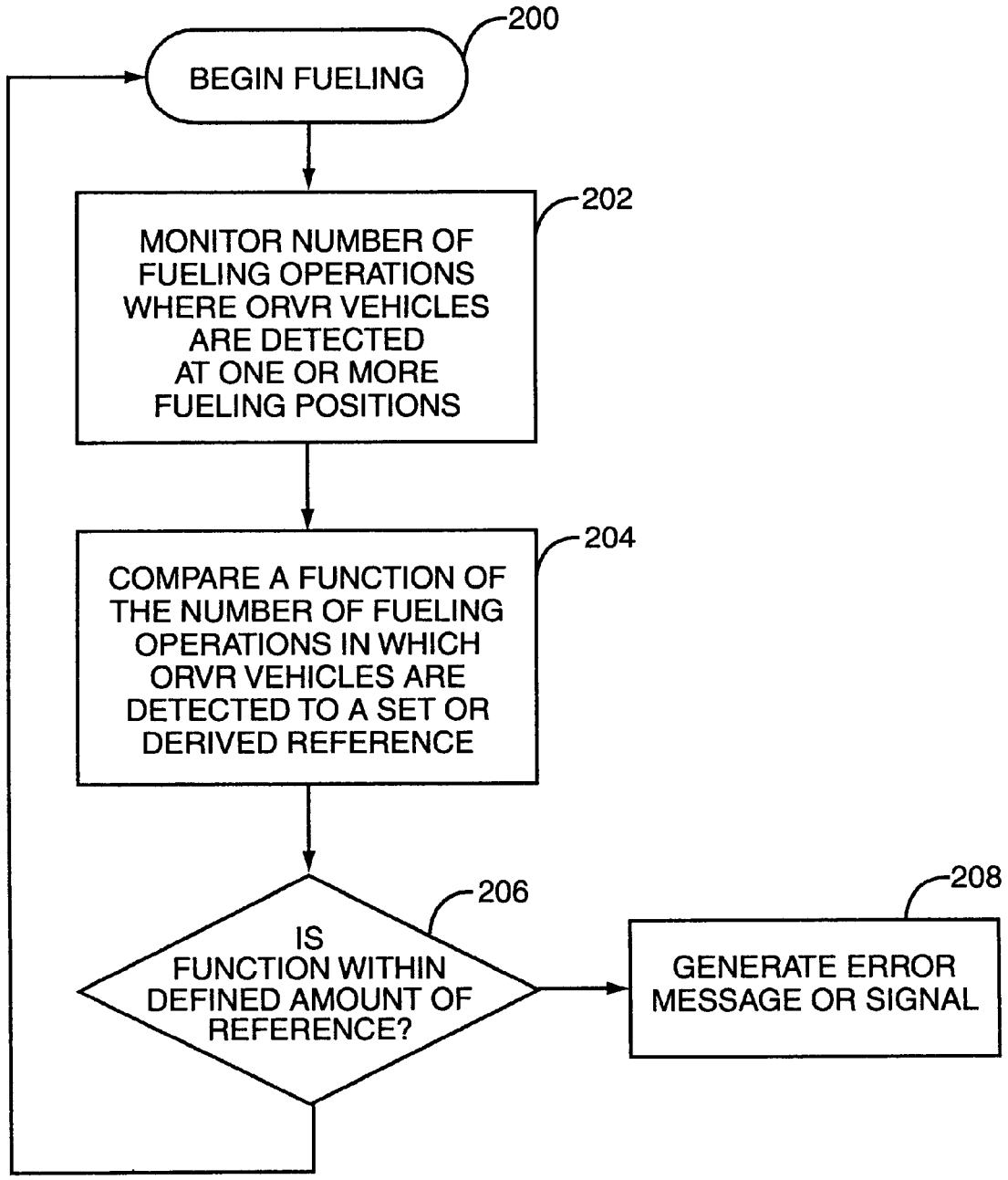
FIG. 4 is a flow chart illustrating another embodiment of the logic of the diagnostic system of the present invention.

With reference to FIG. 4, the flow chart is depicted providing operation of alternative embodiments of the present invention. As shown, general fueling begins 200 and the dispenser or central controller monitors the number of fueling operations where ORVR vehicles are detected at one or more fueling positions 202. The control system at the dispenser or central controller compares a function of the number of fueling operations in which ORVR vehicles are detected to a set or derived reference 202. If the function is within a defined amount of the reference, fueling continues 206. If the function is not within a defined amount of the reference, an error message or signal is generated 208. This error message or signal may be used to stop fueling, alert a station operator or simply provide a historic or diagnostic record of operation.

The general concept of the invention is to monitor the number of fueling operations where ORVR vehicles are detected and compare this number or a function thereof with a reference. The reference may be fixed or derived from the fueling position being monitored, another fueling position or an average of a group of fueling positions. Further, the function may simply be the number of fueling operations in a period, current or past, a ratio of the number of fueling operations where ORVR vehicles were detected to fueling operations where ORVR vehicles were not detected.

In essence, the data compared may take various forms, but the core concept is to compare the functionality of one ORVR vehicle detection system based on an expected reference, fixed or calculated based on prior or current performance of the same or related detection systems at virtually any one or group of fueling positions in the fueling environment.

Of all the various possible combinations, there are three preferred techniques at the writing of this specification. First, the system compares the number of fueling operations where an ORVR vehicle is detected to the number of operations where an ORVR vehicle is not detected. This comparison may be done for an individual fueling position or the fuel dispenser as a whole. The second preferred embodiment is to compare the number of operations where an ORVR vehicle is detected at one fueling position of a fuel dispenser to the number of ORVR vehicle detections at another side of the same dispenser. The third embodiment compares the ratio of fueling operations wherein an ORVR vehicle is detected to the number of fueling operations where an ORVR vehicle is not detected with an average for the entire fueling environment or a group of dispensers therein.

The following table outlines the variables for which the function may depend and a like reference or reference function for which the main function is compared. Notably, virtually any combination or comparison of the reference in function is acceptable.

| POSSIBLE COMPARISONS | POSSIBLE VARIABLES FOR THE DIAGNOSTIC FUNCTION | POSSIBLE VARIABLES FOR THE REFERENCE |
|---|---|---|
| One position to a reference | Number of operations wherein an ORVR vehicle is detected | Predetermined value |
| One position to historical performance of that position | Number of operations wherein an ORVR vehicle is detected over a number of operations | Number of operations wherein an ORVR vehicle is detected over a number of operations for any one or group of positions |
| One position to another position | Number of operations wherein an ORVR vehicle is detected over a number of operations where an ORVR vehicle is not detected | Number of operations wherein an ORVR vehicle is detected over a number of operations where an ORVR vehicle is not detected for any one or group of positions |
| One position to a group of positions, but not including the one position | Number of operations wherein an ORVR vehicle is detected | Number of operations wherein an ORVR vehicle is detected for any one or group of positions |
| One position to a group of positions including the one position | Historical performance of any one or group of positions | Historical performance of any one or group of positions for any one or group of positions |

As noted, the entries in the above table corresponding to any row or column may be matched with other entries from any other row or column to provide a litany of combinations acceptable for providing diagnostics of an ORVR detection system. Further, this table is not all inclusive in that those of ordinary skill will recognize modifications and extensions of these variables acceptable for use in the diagnostic system and falling within the scope of the invention as defined in the claims following the specification.

In yet another preferred embodiment of the present invention as discussed above individual dispenser data may be collected by site controller 80 and analyzed periodically. The site controller 80 could then initiate varying levels of warnings to operating personnel and, if desired, transmit warnings to offsite centralized monitoring locations. It would be readily appreciated that a plurality of locations may be linked via a network and, thus, the warning would be transmitted at the network host level.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What is claimed is:

1. A diagnostic system associated with a detection system capable of determining if a vehicle being fueled has vapor recovery capability, said diagnostic system comprising a control system adapted to:

a. compare a function dependent on a number of fueling operations determined to involve a vehicle having vapor recovery capability with a reference value, and b. detect an error condition in the vapor recovery detection system if said function and said reference value differ by more than a defined amount.

2. The diagnostic system of claim 1 wherein said function is the number of fueling operations determined to involve vehicles having vapor recovery capability.

3. The diagnostic system of claim 1 wherein said function depends on the number of fueling operations determined to involve vehicles having vapor recovery capability in relation to a total number of fueling operations.

4. The diagnostic system of claim 1 wherein said function depends on the number of fueling operations determined to involve vehicles having vapor recovery capability in relation to a number of fueling operations determined to involve vehicles without vapor recovery capability.

5. The diagnostic system of claim 1 wherein said function depends on the number of fueling operations involving vehicles having vapor recovery capability within a select period of time.

6. The diagnostic system of claim 1 wherein said reference value is a predefined value.

7. The diagnostic system of claim 1 wherein said reference value is a function depending a number of fueling operations determined to involve vehicles with vapor recovery capability.

8. The diagnostic system of claim 1 wherein said reference value is a function depending on the number of fueling operations determined to involve vehicles without vapor recovery capability in relation to a total number of fueling operations.

9. The diagnostic system of claim 1 wherein said function is dependent on the number of fueling operations at a first fueling position determined to involve a vehicle having vapor recovery capability.

10. The diagnostic system of claim 1 wherein said reference value is a function depending on a number of fueling operations at a second fueling position determined to involve vehicles with vapor recovery ability.

11. The diagnostic system of claim 10 wherein said first fueling position is on a first side of a fuel dispenser and said second fueling position is on a second side of a fuel dispenser.

12. The diagnostic system of claim 1 wherein said reference value is a function depending on a number of fueling operations at fueling positions other than said first fueling position determined to involve vehicles with vapor recovery capability.

13. The diagnostic system of claim 1 wherein said reference value is a function depending on a number of fueling operations determined to involve vehicles with vapor recovery capability over a prior period of time.

14. A diagnostic system associated with a detection system capable of determining if a vehicle being fueled has vapor recovery capability, said diagnostic system comprising a control system adapted to:

a. compare a function dependent on a ratio of a number of fueling operations determined to involve a vehicle having vapor recovery capability to a number of fueling operation determined to involve a vehicle without vapor recovery capability with a reference value, and b. detect an error condition in the vapor recovery detection system if said function and said reference value differ by more a defined amount.

15. The diagnostic system of claim 14 wherein said number of fueling operations involving vehicles with and without vapor recovery capability is determined from a single fueling position.

16. The diagnostic system of claim 14 wherein said reference is a function depending on a ratio of a number of fueling operations determined to involve a vehicle having vapor recovery capability to a number of fueling operations determined to involve a vehicle without vapor recovery capability at a second fueling position.

17. The diagnostic system of claim 14 wherein said reference is a function depending on a ratio of a number of fueling operations determined to involve a vehicle having vapor recovery capability to a number of fueling operations determined to involve a vehicle without vapor recovery capability at a plurality of fueling positions.

18. The diagnostic system of claim 14 wherein said reference is a function depending on a number of fueling operations determined to involve a vehicle having vapor recovery capability at a second fueling position.

19. The diagnostic system of claim 14 wherein said reference is a function depending on a number of fueling operations determined to involve a vehicle having vapor recovery capability at a plurality of fueling positions.

20. A method for providing diagnostics for a detection system capable of determining if a vehicle being fueled has vapor recovery capability, said diagnostic method comprising:

a. comparing a function dependent on a number of fueling operations determined to involve a vehicle having vapor recovery capability with a reference value, and b. detecting an error condition in the vapor recovery detection system if said function and said reference value differ by more a defined amount.

21. A diagnostic system associated with a detection system capable of determining if a vehicle being fueled has vapor recovery capability, said diagnostic system comprising a control system adapted to:

a. compare with a reference value a function dependent on at least one of the group including:

i. the number of fueling operations determined to involve a vehicle having vapor recovery capability, ii. the number of fueling operations determined to involve vehicles having vapor recovery capability in relation to a total number of fueling operations, iii. the number of fueling operations determined to involve vehicles having vapor recovery capability in relation to a number of fueling operations determined to involve vehicles without vapor recovery capability, and iv. the number of fueling operations involving vehicles having vapor recovery capability within a select period of time;

b. detect an error condition in the vapor recovery detection system if said function and said reference value differ by more a defined amount.

22. A method for monitoring the operation of a vacuum assist vapor recovery system used in conjunction with the fueling of ORVR and non-ORVR equipped vehicles comprising:

a. establishing an expected number of ORVR fueling operations for a fuel dispenser during a given time interval;

b. counting the actual number of ORVR fueling operations during said given time interval;

c. comparing the actual number of ORVR fueling operations to the expected number of ORVR fueling operations; and d. permitting fueling operations to continue if the actual number is substantially equal to the expected number.

23. A method according to claim 22 further including generating an error signal if the actual number is not substantially equal to the expected number.

24. A method according to claim 23 wherein said error signal is an audible signal.

25. A method according to claim 23 wherein said error signal is a visual signal.

26. A method according to claim 23 further comprising stopping fueling operations if the actual number is not substantially equal to the expected number.

27. A method according to claim 23 wherein said vapor recovery system serves a plurality of fuel dispensers and said step of counting the actual number of ORVR fueling operations includes maintaining a separate count of the actual number of ORVR fueling operations for each of said plurality of dispensers.

28. A method according to claim 27 further comprising comparing said separate count to an average number of ORVR fueling operations counted for all of said plurality of fuel dispensers to determine if said vapor recovery system is operating properly.

29. A fuel dispenser including a vapor recovery system comprising:

a. a dispenser sub-system capable of making an ORVR vehicle determination during a fueling operation;

b. a counter adapted to count the number of ORVR determinations made by said dispenser subsystem;

c. a storage location for storing an expected number of ORVR determinations to be made by said subsystem;

d. a diagnostic controller for comparing the actual number of fueling operations to the expected number of fueling operations wherein said controller is adapted to permit fueling operations to continue if the actual number is substantially equal to the expected number.

30. The fuel dispenser of claim 29 wherein said dispenser includes a first dispensing station and a second dispensing station and said counter maintains a first count of ORVR vehicle determinations made at said first station and a second count of ORVR vehicle determinations made at said second station.

31. The fuel dispenser of claim 30 wherein said diagnostic controller is adapted to compare said first count of ORVR vehicle determinations to said second count of ORVR vehicle determinations to determine whether the vapor recovery system is functioning correctly.

* * * * *